US006994607B2

(12) United States Patent
Wiswesser

(10) Patent No.: US 6,994,607 B2
(45) Date of Patent: Feb. 7, 2006

(54) POLISHING PAD WITH WINDOW

(75) Inventor: Andreas Norbert Wiswesser, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 25 days.

(21) Appl. No.: 10/464,423

(22) Filed: Jun. 18, 2003

(65) Prior Publication Data

US 2004/0033758 A1 Feb. 19, 2004

Related U.S. Application Data

(63) Continuation-in-part of application No. 10/035,391, filed on Dec. 28, 2001, now Pat. No. 6,716,085, and a continuation-in-part of application No. 10/282,730, filed on Oct. 28, 2002, now Pat. No. 6,832,950.

(60) Provisional application No. 60/390,679, filed on Jun. 21, 2002, and provisional application No. 60/402,416, filed on Aug. 9, 2002.

(51) Int. Cl.
*B24B 7/22* (2006.01)

(52) U.S. Cl. ..... 451/5; 451/6; 451/285; 156/636.1; 437/225

(58) Field of Classification Search ..... 451/6, 451/7, 285, 286–290; 156/636.1, 626; 437/7, 437/225

See application file for complete search history.

(56) References Cited

U.S. PATENT DOCUMENTS

| | | | |
|---|---|---|---|
| 4,660,980 | A | 4/1987 | Takabayashi et al. |
| 4,927,485 | A | 5/1990 | Cheng et al. |
| 5,081,796 | A | 1/1992 | Schultz |

(Continued)

FOREIGN PATENT DOCUMENTS

| | | |
|---|---|---|
| CA | 625573 | 8/1961 |
| EP | 0 352 740 | 1/1990 |
| EP | 0 468 897 | 1/1992 |

(Continued)

OTHER PUBLICATIONS

Anon., "End–Pint Detection of Oxide Polishing and Planarization of Semiconductor Devices," *Research Disclosure*, 340 (Aug. 1992).

Nakamura, Takao et al., "Mirror Polishing of Silicon Wafter ($4^{th}$ Report)—Development of Bowl Feed and Double Side Polishing Machine with In–situ Thickness Monitoring of Silicon Wafers," (JSPE–59–04, 93–04–661).

Rodel, "Glass Polishing Pads", Jan. 1993, Scottsdale, Arizona, 2 pp.

*Primary Examiner*—Lee D. Wilson
*Assistant Examiner*—Anthony Ojini
(74) *Attorney, Agent, or Firm*—Fish & Richardson P.C.

(57) ABSTRACT

Polishing pads with a window, systems containing such polishing pads, and processes that use such polishing pads are disclosed.

22 Claims, 2 Drawing Sheets

U.S. PATENT DOCUMENTS

| | | | | | |
|---|---|---|---|---|---|
| 5,196,353 | A | | 3/1993 | Sandhu et al. | |
| 5,257,478 | A | | 11/1993 | Hyde et al. | |
| 5,413,941 | A | | 5/1995 | Koos et al. | |
| 5,427,878 | A | | 6/1995 | Corliss | |
| 5,433,651 | A | * | 7/1995 | Lustig et al. | 451/6 |
| 5,461,007 | A | | 10/1995 | Kobayashi | |
| 5,489,233 | A | | 2/1996 | Cook et al. | |
| 5,499,733 | A | | 3/1996 | Litvak | |
| 5,605,760 | A | | 2/1997 | Roberts | |
| 5,609,511 | A | | 3/1997 | Moriyama et al. | |
| 5,640,242 | A | | 6/1997 | O'Boyle et al. | |
| 5,658,183 | A | | 8/1997 | Sandhu et al. | |
| 5,663,797 | A | | 9/1997 | Sandhu | |
| 5,672,091 | A | | 9/1997 | Takahashi et al. | |
| 5,722,875 | A | | 3/1998 | Iwashita et al. | |
| 5,741,070 | A | | 4/1998 | Moslehi | |
| 5,773,316 | A | | 6/1998 | Kurosaki et al. | |
| 5,791,969 | A | | 8/1998 | Lund | |
| 5,816,891 | A | | 10/1998 | Woo | |
| 5,838,447 | A | | 11/1998 | Hiyama et al. | |
| 5,868,896 | A | | 2/1999 | Robinson et al. | |
| 5,872,633 | A | | 2/1999 | Holzapfel et al. | |
| 5,893,796 | A | | 4/1999 | Birang et al. | |
| 5,949,927 | A | | 9/1999 | Tang | |
| 5,964,643 | A | | 10/1999 | Birang et al. | |
| 6,010,538 | A | | 1/2000 | Sun et al. | |
| 6,045,439 | A | | 4/2000 | Birang et al. | |
| 6,068,539 | A | | 5/2000 | Bajaj et al. | |
| 6,071,177 | A | | 6/2000 | Lin et al. | |
| 6,111,634 | A | * | 8/2000 | Pecen et al. | 356/72 |
| 6,146,248 | A | | 11/2000 | Jairath et al. | |
| 6,179,709 | B1 | | 1/2001 | Redeker et al. | |
| 6,190,234 | B1 | | 2/2001 | Swedek et al. | |
| 6,247,998 | B1 | | 6/2001 | Wiswesser et al. | |
| 6,248,130 | B1 | | 6/2001 | Perry | |
| 6,254,459 | B1 | * | 7/2001 | Bajaj et al. | 451/41 |
| 6,280,290 | B1 | | 8/2001 | Birang et al. | |
| 6,361,403 | B1 | * | 3/2002 | Kuramochi et al. | 451/41 |
| 6,361,646 | B1 | | 3/2002 | Bibby, Jr. et al. | |
| 6,447,369 | B1 | | 9/2002 | Moore | |
| 6,454,630 | B1 | * | 9/2002 | Tolles | 451/6 |
| 6,458,014 | B1 | * | 10/2002 | Ihsikawa et al. | 451/6 |
| 6,511,363 | B2 | * | 1/2003 | Yamane et al. | 451/6 |
| 6,517,417 | B2 | | 2/2003 | Roberts et al. | |
| 6,524,164 | B1 | | 2/2003 | Tolles | |
| 6,537,133 | B1 | | 3/2003 | Johansson et al. | |
| 6,607,422 | B1 | | 8/2003 | Swedek et al. | |
| 6,609,947 | B1 | * | 8/2003 | Moore | 451/5 |
| 6,676,583 | B2 | | 1/2004 | Walsh | |
| 6,676,717 | B1 | | 1/2004 | Birang et al. | |
| 6,688,945 | B2 | * | 2/2004 | Liu | 451/6 |
| 6,719,818 | B1 | | 4/2004 | Birang et al. | |
| 2001/0031610 | A1 | | 10/2001 | Budinger et al. | |

FOREIGN PATENT DOCUMENTS

| | | |
|---|---|---|
| EP | 0 663 265 | 7/1995 |
| EP | 0 738 561 | 10/1996 |
| EP | 0 824 995 | 2/1998 |
| EP | 0 881 040 | 12/1998 |
| EP | 0 881 484 | 12/1998 |
| EP | 1 025 954 | 8/2000 |
| FR | 1075634 | 10/1954 |
| JP | 57-138575 | 8/1982 |
| JP | 58-178526 | 10/1983 |
| JP | 58-004353 | 11/1983 |
| JP | 59-74635 | 4/1984 |
| JP | 61-164773 | 7/1986 |
| JP | 62-190728 | 8/1987 |
| JP | 62-211927 | 9/1987 |
| JP | 62-283678 | 12/1987 |
| JP | 63-256344 | 10/1988 |
| JP | 259938 | 10/1989 |
| JP | H2-86128 | 7/1990 |
| JP | 2-222533 | 9/1990 |
| JP | 3-234467 | 10/1991 |
| JP | 5 138531 | 6/1993 |
| JP | 5-309558 | 11/1993 |
| JP | 6037076 | 2/1994 |
| JP | 7-052032 | 2/1995 |
| JP | 7-235520 | 9/1995 |
| JP | 7-284050 | 9/1995 |
| JP | 9036072 | 7/1997 |
| JP | 291686 | 10/2001 |
| WO | WO 93/20976 | 10/1993 |
| WO | WO 94/07110 | 3/1994 |

* cited by examiner

FIG. 1
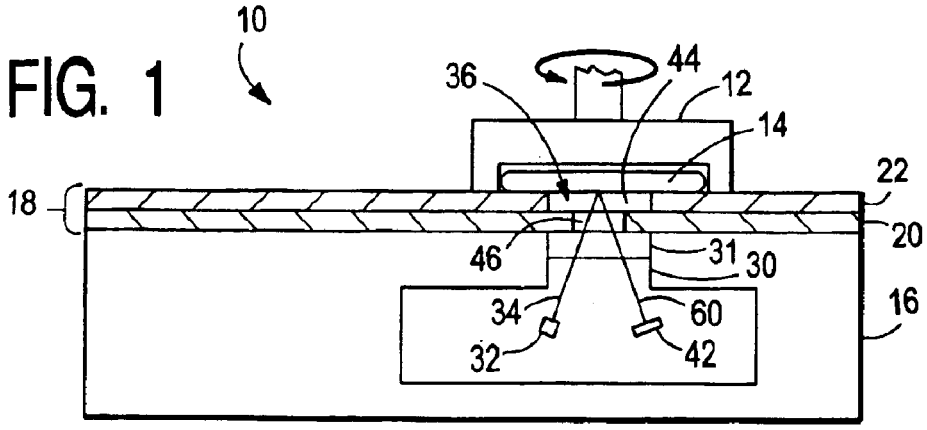
FIG. 2
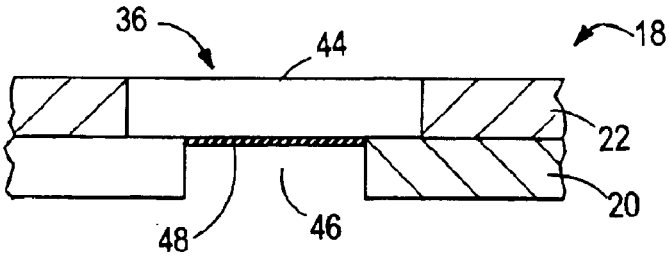
FIG. 3
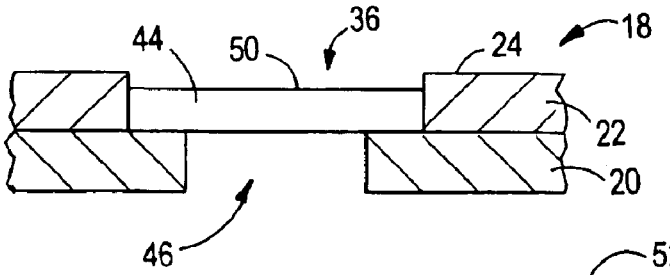
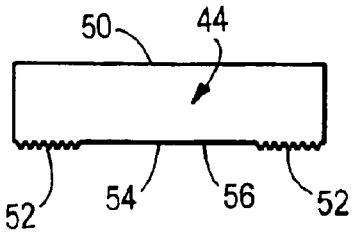
FIG. 4A
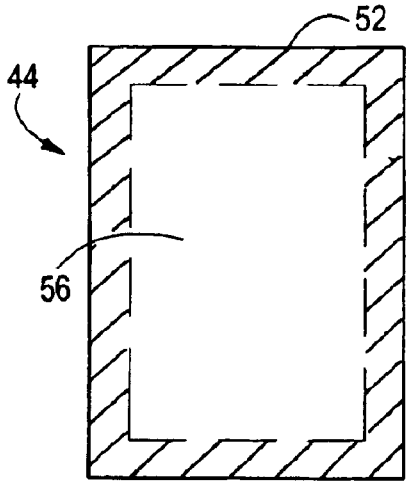
FIG. 4B

POLISHING PAD WITH WINDOW

CROSS-REFERENCE TO RELATED APPLICATIONS

This application is a continuation-in-part of and claims priority under 35 U.S.C. §120 to U.S. patent application Ser. Nos. 10/035,391, filed Dec. 28, 2001 now U.S. Pat. No. 6,716,085, and entitled "Polishing Pad with Transparent Window," and Ser. No. 10/282,730, filed Oct. 28, 2002 now U.S. Pat. No. 6,832,950, and entitled "Polishing Pad with Window." This application also claims priority under 35 U.S.C. §119 to U.S. Provisional Patent Application No. 60/390,679, filed Jun. 21, 2002, and entitled "Polishing Pad with Transparent Window," and Ser. No. 60/402,416, filed Aug. 9, 2002, and entitled "Method and Apparatus for Optical Monitoring a Substrate During Polishing." The entire contents of each of these applications is incorporated by reference herein.

TECHNICAL FIELD

The invention generally relates to polishing pads with a window, systems containing such polishing pads, and processes for making and using such polishing pads.

BACKGROUND

The process of fabricating modem semiconductor integrated circuits (IC) often involves forming various material layers and structures over previously formed layers and structures. However, the underlying features can leave the top surface topography of an in-process substrate highly irregular, with bumps, areas of unequal elevation, troughs, trenches, and/or other surface irregularities. These irregularities can cause problems in the photolithographic process. Consequently, it can be desirable to effect some type of planarization of the substrate.

One method for achieving semiconductor substrate planarization or topography removal is chemical mechanical polishing (CMP). A conventional chemical mechanical polishing (CMP) process involves pressing a substrate against a rotating polishing pad in the presence of a slurry, such as an abrasive slurry.

In general, it is desirable to detect when the desired surface planarity or layer thickness has been reached and/or when an underlying layer has been exposed in order to determine whether to stop polishing. Several techniques have been developed for the in situ detection of endpoints during the CMP process. For example, an optical monitoring system for in situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad. A layer of slurry is typically present between the substrate and an upper surface of the window.

SUMMARY

In one aspect, the invention is directed to a polishing pad with a polishing layer having a polishing surface and a solid transparent window located in the polishing layer. The window is formed of a polymer material that provides the window with at least 80% transmission to light having a wavelength of about 400 to 410 nanometers (nm).

Implementations of the invention may include one or more of the following. The material may be a polyurethane that substantially free of additives and substantially free of internal defects. The material is a non-ambering urethane elastomer. The material may be polychlorotrifluoroethylene. The window may have at least 80% transmission to light having a wavelength of 350 nm, and may have at least 80% transmission to light having any wavelength between 350 nm and 700 nm. The material may be hydrophilic. The material may have a hardness between 40 and 80 Shore D. There may be an antireflective coating on a bottom surface of the window.

In another aspect, the invention is directed to a polishing pad with a polishing layer having a polishing surface, a solid transparent window located in the polishing layer, and an anti-reflective coating on a bottom surface of the window opposite the polishing surface. Implementations of the invention may include one or more of the following features. The polishing pad may have a top surface that is recessed relative to the polishing surface. A bottom surface of the window may include a central portion and a perimeter portion, and the perimeter portion may be rougher than the central portion.

In another aspect, the invention is directed to a polishing pad with a polishing layer having a polishing surface and a solid transparent window located in the polishing layer. A top surface of the transparent window is recessed relative to the polishing surface.

Implementations of the invention may include one or more of the following features. The top surface of the transparent window may be recessed relative to the polishing surface by less than 5 mils, e.g., by between 1 to 2 mils. There may be an anti-reflective coating on a bottom surface of the window opposite the top surface.

In another aspect, the invention is directed to a polishing pad with a polishing layer having a polishing surface and a solid transparent window located in the polishing layer. A bottom surface of the window includes a central portion and a perimeter portion, and the perimeter portion is rougher than the central portion.

Implementations of the invention may include one or more of the following features. The polishing pad may have on the side of polishing layer opposite the polishing surface. The window may abut the backing layer. The backing layer may includes an aperture aligned with the window in the polishing layer.

In another aspect, the invention is directed to a window for a polishing pad with a transparent article having a polishing side and an opposing side, and an anti-reflective coating on the opposite side of the window.

In another aspect, the invention is directed to a window for a polishing pad with a transparent article having a bottom surface that includes a central portion and a perimeter portion. The perimeter portion is rougher than the central portion.

In another aspect, the invention is directed to a method of constructing a polishing pad in which an anti-reflective coating is disposed on a bottom side of a solid transparent window, and the window is secured in an aperture in a polishing pad.

In another aspect, the invention is directed to a method of constructing a polishing pad in which a solid transparent window is secured in an aperture in a polishing pad so that a top surface of the window is recessed relative to a polishing surface of the polishing pad. In another aspect, the invention is directed to a method of constructing a polishing pad in which a perimeter portion of a solid transparent window is roughened, and the window is secured in an aperture in the polishing pad so that the perimeter portion contacts the polishing pad.

In certain embodiments, the window-polishing pad construction can exhibit one or more of the following desirable characteristics: good transmission of energy at the wavlength(s) of interest; negligible diffusing capabilities; good resistance to scratching and/or abrasion during the CMP process, good resistance to fluid (e.g., slurry or water) leakage; and/or relatively low refractive index. CMP systems containing such window-polishing pad constructions can exhibit one or more of the following desirable characteristics: reduced scattering and reflecting of the light beam at the upper surface of the window due to scratches and irregularities; reduced reflection of the light beam at the interface between the window and the slurry may be reduced; improved the signal-to-noise ratio in the signal from the detector; reduced slurry leakage around the perimeter of the window.

In some embodiments, at least two (e.g., all) of these properties are exhibited despite the window being made from a material that generally has relatively low surface energy (e.g., low adhesion to many other materials). This can be particularly advantageous when the material from which the window is made has a relatively low surface energy (e.g., polytetrafluoroethylene) and when the window material has good transmission in the blue range of the visible spectrum (e.g., from about 400 nm to about 450 nm, such as from about 400 nm to about 410 nm), which is desirable when a blue laser or a blue LED is used as the light source.

Features, objects and advantages of the invention are in the description, drawings and claims.

BRIEF DESCRIPTION OF THE DRAWINGS

FIG. 1 is a schematic cross-sectional side view of a polishing station from a chemical mechanical polishing system.

FIG. 2 is a schematic cross-sectional side view of a polishing pad having an antireflective coating on a bottom surface of the window.

FIG. 3 is a schematic cross-sectional side view of a polishing pad in which the window is recessed from the polishing surface.

FIG. 4A is a schematic cross-sectional side view of a window having a roughened bottom surface.

FIG. 4B is a schematic bottom view of a window having a roughened bottom surface.

Like reference symbols in the various drawings indicate like elements.

DETAILED DESCRIPTION

Figure 5:
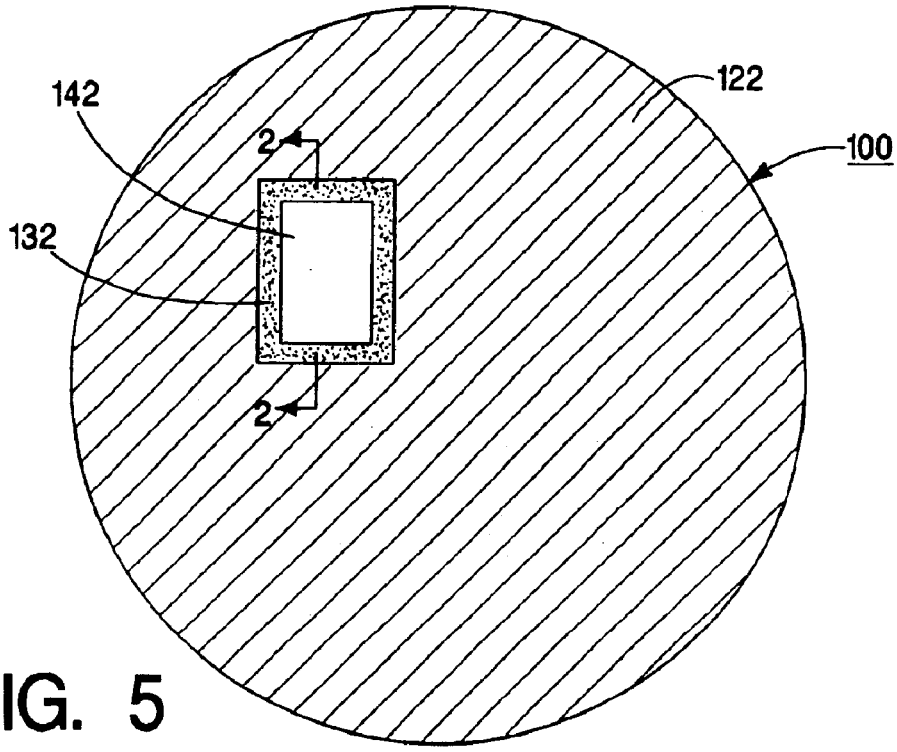
FIG. 5 is a schematic top view of an embodiment of a polishing pad with a window.

As shown in FIG. 1, a CMP apparatus 10 includes a polishing head 12 for holding a semiconductor substrate 14 against a polishing pad 18 on a platen 16. CMP apparatuses are disclosed in U.S. Pat. Nos. 5,738,574 and 6,247,998, and commonly owned and copending U.S. patent application Ser. No. 10/358,852, filed on Feb. 4, 2003, and entitled "Substrate Monitoring During Chemical Mechanical Polishing," the entire contents of each of which are incorporated by reference herein.

Polishing pad 18 can be a two-layer pad with a backing layer 20 that interfaces with the surface of the platen 16 and a covering layer 22 with a polishing surface to contact the substrate. For example, the covering layer 22 can be a durable rough layer (e.g., Rodel IC-1000), whereas the backing layer can be a more compressible layer (e.g., Rodel Suba-IV). However, some pads have only a covering layer and no backing layer. Alternatively, the polishing pad can be a fixed-abrasive pad with abrasive particles held in a containment media.

Typically the polishing pad material is wetted with the chemical polishing solution or slurry with a chemically reactive agent, and, assuming a "standard" polishing pad, abrasive particles. However, some polishing processes are "abrasiveless".

A hole 30 is formed in the top surface of the platen 16 and is aligned with a window 36 formed in the overlying polishing pad 18. The window can be, for example, a solid transparent insert 44 secured in the covering layer 22. An aperture 46 can be formed through the backing layer 20 and aligned with the window 36. In addition, at least part of the hole 30 can be filled with a transparent solid piece 31, such as a quartz block. The hole 30 and the window 36 are positioned such that they have a view of the substrate 14 held by the polishing head 12 during a portion of the platen's rotation, regardless of the translational position of the head 12.

An optical monitoring system, including a light source 32 (e.g., a laser, such as a red laser, a blue laser, or an infrared laser, or a light emitting diode, such as a red light emitting diode, a blue light emitting diode, or an infrared light emitting diode) and a detector 42 (e.g., a photodetector) are fixed below the top surface of the platen 16. For example, the optical monitoring system can be located in a recess or space 17 inside the platen 16 and can rotate with the platen. Alternatively, the optical monitoring system could be a stationary system located below the platen. The light source 32 projects a light beam 34 through the aperture 30 and the window 36 in the polishing pad 18 to strike the surface of the overlying substrate 14 (e.g., a semiconductor substrate) at least during a time when the window 36 is adjacent the substrate 14. Light reflected from the substrate forms a resultant beam 60 that is detected by the detector 42. An unillustrated computer receives the measured light intensity from the detector 42 and uses it to determine the polishing endpoint, e.g., by detecting a sudden change in the reflectivity of the substrate that indicates the exposure of a new layer, by calculating the thickness removed from of the outer layer (such as a transparent oxide layer) using interferometric principles, or by monitoring the signal for predetermined endpoint criteria.

Slurry applied to the polishing pad 18 during the polishing operation can form a layer 38 between the substrate 14 and the polishing pad 18, including the upper surface of the window 36. However, the interface between the window 36 and the polishing pad 18 is sealed, so that the slurry 38 cannot leak through to the platen 16.

The window 36 should have at least some of the following properties: chemical resistance to the slurry or other materials used in the polishing process; good optical clarity (e.g., at least about 25% light transmission over the wavelength range of the light beam); a low refractive index (e.g., less than about 1.48); an index of refraction that is about the same as the index of refraction of the slurry; non-diffusing;

and highly optically isotropic. The window can be a polymer material, such as a polyurethane or a fluoropolymer.

A low refractive index that is about the same as that of the slurry and a high optical clarity can reduce reflections from the air/window/water interface and improve transmission of the light through the window to and from the substrate, thereby improving the signal-to-noise ratio. The optical clarity should be high enough to provide at least about 25% (e.g., at least about 50%, at least about 80%, at least about 90%, at least about 95%) light transmission over the wavelength range of the light beam used by the detector. Typical wavelength ranges include the visible spectrum (e.g., from about 400 nm to about 800 nm), the ultraviolet (UV) spectrum (e.g., from about 300 nm to about 400 nm), and/or the infrared spectrum (e.g., from about 800 nm to about 1550 nm). In certain implementations, the wavelength range of interest can be within a certain portion of the visible spectrum, such as the blue portion of the visible spectrum (e.g., from about 400 nm to about 470 nm, from about 400 nm to about 415 nm, from about 400 nm to about 410 nm, about 405 nm, or about 470 nm). In some implementations, it can be particularly desirable for the material to have a high transmittance (e.g., at least about 80%, at least about 90%, at least about 95%) in the low wavelength range around blue light and UV light (e.g., less than about 415 nm).

These lower wavelengths are useful when conducting optical measurements during shallow trench isolation (STI) using fixed abrasive (FA) or high selectivity slurry (HSS). The use of a light source generating a light beam at around 400–415 nm is advantageous in STI polishing. The active area of an STI device begins (from the outermost layer) with an oxide layer of about 1000–2000 Angstroms thickness, a nitride layer, a thin oxide layer (about 200 Angstroms), and finally the silicon. During the STI polishing process, it is desired to remove the outermost oxide layer from the active area and halt polishing within the nitride layer, ideally removing less than 200 Angstroms of nitride. No portion of the thin oxide layer should be removed. Because the nitride and oxide layers have similar refractive index, the polishing transition from the oxide layer to the nitride layer may not create a sudden change in the signal from the detector 42. Consequently, one endpoint detection approach in STI polishing is to polish for a preset number of interference fringes and then polish for an additional percentage of an interference cycle (termed a "supplemental" polish step herein). This should result in polishing to a desired thickness. Assuming that the number of fringes, and the percentage of the cycle for the supplemental polish step, are selected properly, polishing should halt after only a small amount of the nitride layer has been removed.

However, one potential problem is that polishing rates can fluctuate slightly, even during polishing of the same substrate. If the amount of material removed in the supplemental polishing step can be reduced, the time and thickness of material removed while at an uncertain polishing rate can be reduced, and polishing can be halted at the target thickness with greater accuracy.

An endpoint detector using a wavelength of 400–415 nm has better peak-to-peak resolution (amount of material removed between interference fringes) than an endpoint detector using a wavelength in the red region of the spectrum (e.g., at about 670 nm). Specifically, during polishing of an oxide layer with refractive index 1.46, the wavelength of 400–415 nm can provide a peak-to-peak thickness $\Delta D$ of 1400 Angstroms, in contrast to a peak-to-peak thickness $\Delta D$ of 2400 Angstroms for red light. Since the blue(indigo) wavelength light creates more interference fringes in the signal from the detector 42, it is more likely that an interference fringe will occur near the target thickness, and less material will need to be removed during the supplemental polishing step. In addition, due to the relatively small incoming thickness variation of the oxide layer, there is little likelihood of an erroneous endpoint detection.

For similar reasons, the use of a light source generating a light beam at around 400–415 nm is advantageous in polishing of spin-on glass, such as Boron Phosphate Spin-on Glass (BPSG) polishing and in Silicon-on-Insulator (SOI) polishing. In a BPSG process, a spin-on-glass is deposited over a nitride layer, and the glass is then polished away without removing a significant portion (e.g., less than 200 Angstroms) of the nitride. In a SOI process, a first implanted and oxidized silicon wafer is bonded to a second silicon wafer, and the first silicon substrate is split to provide a thin implanted silicon layer on top of the oxide layer. The outer silicon layer is then polished to planarize the silicon surface, without removing a signficant portion (e.g., less than 50 Angstroms) of the silicon itself. Since the blue(indigo) wavelength light creates more interference fringes in the signal from the detector 42, it is more likely that an interference fringe will occur near the target thickness, and polishing can be halted at the target thickness with greater accuracy.

Greater than 80% transmission over the wavelength range of about 400 nm to about 410 nm can permit the use of UV/blue LEDs. In contrast, currently available windows typically have a transmission of 20% or less in the wavelength range around about 400 nm to about 410 nm.

If the refractive index of the window material is low enough to be close to the index of the slurry, reflections at the window/slurry interface can be reduced. The refractive index can be less than about 1.48 (e.g., less than about 1.45, less than about 1.4, less than about 1.35, about the same as the refractive index of water). In some implementations, the refractive index of the window material can be within about 0.07 (e.g., within about 0.03, within about 0.01) of the refractive index of the slurry. In certain implementations, the refractive index of the window material can be within about 5.5% (e.g., within about 1%) of the refractive index of the slurry. Using such window pad materials can increase the real signal and reduce the background signal, thereby improving signal-to-noise ratio of the optical intensity measurements.

The window material can also be a highly optically isotropic polymer. Most polymers are by nature non-isotropic. However, a window material that is molded under low stress can exhibit better isotropic optical properties. An isotropic material can help maintain the polarization of the interrogating light beam. The window material can be more isotropic than conventional polyurethanes, that are used as window material.

A hydrophilic material can help ensure that there is always a layer of slurry or water between the substrate and the window. The presence of the layer of slurry or water can prevent the creation of a window/air/wafer interface which can cause significant signal distortion. Although polymer materials tend to be hydrophobic, they can be changed from hydrophobic to hydrophilic using surface treatments, such as roughening or etching. However, for certain applications it may be useful to have a hydrophobic window. For example, if a substrate being polished has a hydrophilic layer ($SiO_2$, $Si_3N_4$, etc.) on top of hydrophobic layer (Poly Silicon, single crystal Silicon, etc.), then the tendency of the substrate to repel water will increase as the hydrophobic layer is polished away. This transition is detectable by monitoring the intensity signal from the detector.

The window should be sufficiently hard that the substrate does not abrade the window. A soft material (such as a material having a hardness in the Shore A range) has the tendency to deflect under the load from the substrate. The substrate can then dig into the soft window and contact the edge of the harder surrounding polishing pad. This effect can create scratches and eventually can cause chipping of the window. Therefore, the window should be about the same hardness of the surrounding polishing pad material (or only slightly softer). In general, a hardness in the Shore D 40–95 (e.g., 40–80) range is suitable.

Examples of window materials that can be used include silicone, polyurethane and halogenated polymers (e.g., fluoropolymers). Examples of fluoropolymers include polychlorotrifluoroethylene (PCTFE), perfluoroalkoxy (PFA), fluorinated ethylene propylene (FEP), polytetrafluoroethylene (PTFE), poly pentadecafluorooctylacrylate (refractive index of 1.339), poly tetrafluoroethylene (refractive index of 1.350), poly undecafluororexylacrylate (refractive index of 1.356), poly nonafluropentylacrylate (refractive index of 1.360), poly heptafluorobutylacrylate (refractive index of 1.367), poly trifluorovinylacetate (refractive index of 1.375).

A commercially available material having most of the desired properties is Calthane ND 3200 polyurethane (Cal Polymers, Long Beach, Calif.). The material is a two part clear non-ambering urethane elastomer, and it has a transmittance of at least 80% (for a 150 mil thick sheet) for wavelengths of 350 nm and greater (out to the end of the visible light spectrum at about 700 nm). The material has a refractive index of about 1.48. Without being limited to any particular theory, it is believed that the high transmission of this polyurethane material (in contrast to currently available polyurethane window materials) is the use of a polyurethane that is substantially free of internal defects. Although current polyurethanes used for windows are generally free of additives, the such materials can include internal defects, such as bubbles or voids, cracks, or microdomains (e.g., small areas of differing crystalline structure or orientation) that act to diffuse or scatter the light. By forming the polyurethane substantially free of internal defects, it is possible to achieve a high optical clarity.

Another commercially available material having most of the desired properties is Conoptic DM-2070 polyurethane (Cytec Olean, Olean, N.Y.). The material has a transmittance of at least 80% (for a 150 mil thick sheet) for wavelengths of 350 nm and greater (out to the end of the visible light spectrum at about 700 mn), and can be made with a harness of about 45 to 57 Shore D (slightly softer than "Calthane ND3200").

Additional examples of commercially available window materials include FEP X 6301, FEP X 6303, FEP X 6307, PFA 6502 N, PFA 6505 N, PFA 6510 N and PFA 6515 N (all from Dyneon LLC, Oakdale, Minn.), the Neoflon® family of PCTFE polymers (from Daikin America, Inc., Orangeburg, N.J.) and the Teflon® family of PTFE polymers (from E. I. du Pont de Nemours and Company, Wilmington, Del.). PCTFE, which is a hydrophobic material, is available with a transmittance of at least 80% (for a 32 mil thick sheet) for wavelengths of 300 nm and greater (out to the end of the visible light spectrum at about 700 nm), a refractive index of about 1.33, and a hardness of about 75 to 80 Shore D.

Referring to FIG. 2, in one implementation, an antireflective coating 48 is formed on the bottom surface of the window 36. Such an anti-reflective coating can reduce the reflection at the interface between the aperture 46 and the insert 44 to essential zero, thereby enhancing the signal from the substrate.

Referring to FIG. 3, in another implementation, a top surface 50 of the window 36 is slightly recessed relative to the polishing surface 24 of the covering layer 22. The recess can be very small, and can be less than 5 mils, e.g., approximately 1–2 mils, relative to the polishing surface of the surrounding pad. By very slightly recessing the window, scratching and wear of the window surface can be reduced, thereby improving the consistency of the optical signal throughout the polishing pad lifetime.

Referring to FIGS. 4A and 4B, an outer edge portion 52 of the bottom surface 54 of the transparent insert 44 is roughened before the insert 44 is secured to the polishing pad 18. The center portion 56, surrounded by the edge portion 52, can be a smooth surface. Thus, the edge portion 52 is rougher than the center portion 56. The edge portion can be roughened by, for example, etching or mechanical abrasion. By roughening the edge of the bottom surface 54 (which contacts the backing layer 20), the bonding of the window to the polishing pad can be improved. In additional, the adhesive that bonds the window to the polishing pad can be selected for a strong bond between the specific materials of the covering layer 22 and the insert 44.

Figure 6:
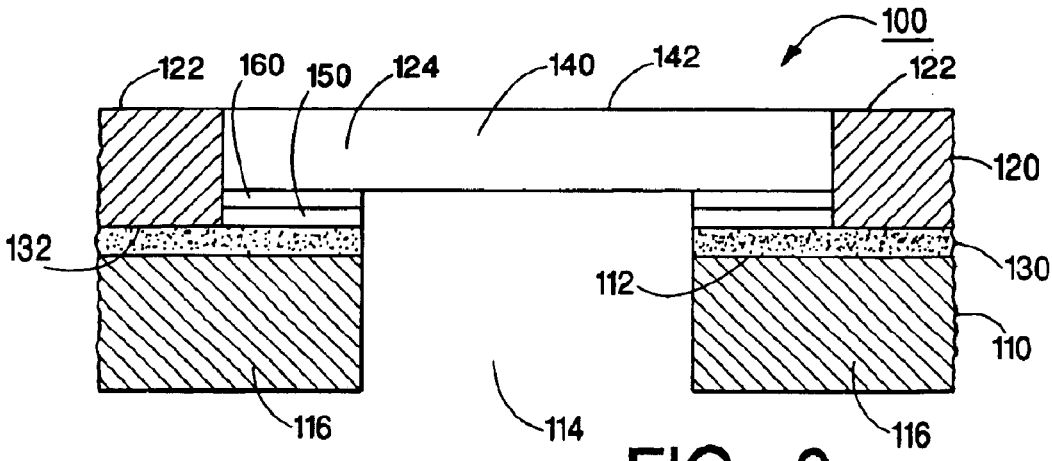
FIG. 6 is a cross-sectional view of the polishing pad of FIG. 5.

FIGS. 5 and 6 illustrate an alternative implementation of a polishing pad 100 having a window 140 formed of a material that has relatively high surface energy, such as a surface energy of at least about 42 $mJ/m^2$ (e.g., at least about 44 $mJ/m^2$, at least about 45 $mJ/m^2$, at least about 46 $mJ/m^2$). The surface energy of a material refers to the is measured by, for example, ASTM D5725-99. In general, window 140 is formed of one of the window materials noted above.

Pad 100 includes a backing layer 110 having an upper surface 112 and a covering layer 120 having a polishing surface 122. An opening 114 in layer 110 is aligned with an opening 124 in layer 120 such that ledges 116 of layer 110 extend under a portion of opening 124. Backing layer 110 and covering layer 120 are held together by an adhesive layer 130 that extends along upper surface 112 of backing layer 110. A window of solid material 140 is disposed in opening 114 and is held in place by an adhesive layer 160. Layer 160 is adhered to adhesive layer 150, which, in turn, is adhered to an upper surface 132 of layer 130. Although the sidewalls of window 140 are depicted as being flush with the sidewalls of covering layer 120, in some embodiments, there is a small gap between the sidewalls of window 140 and the sidewalls of covering layer 120. In addition, although the top surface of the window 140 is depicted as flush with the polishing surface 122 of the covering layer 120, in some embodiments the top surface can be recessed below the polishing surface 122.

In general, backing layer 110, covering layer 120 and adhesive layer 130 can be formed of any appropriate materials for use in CMP processes. For example, layers 110, 120 and 130 can be formed from materials used in the corresponding layers in commercially available polishing pads, such as an IC-1000 polishing pad or IC-1010 polishing pad (from Rodel, Phoenix, Ariz.). In some embodiments, backing layer 110 is formed of a relatively compressible layer, such as a Suba-IV layer (from Rodel, Phoenix Ariz.). In certain embodiments, adhesive layer 130 is formed of a double coated film tape. Commercially available double coated film tapes are available from, for example, Minnesota Mining and Manufacturing Co., Inc. (St. Paul, Minn.) (e.g., a member of the 442 family of double coated film tapes). Adhesive tapes from which layer 130 can be formed are also commercially available from, for example, Scapa North America (Windsor, Conn.).

In certain embodiments, the surface of a material can be modified (e.g., by corona treatment, flame treatment and/or fluorine gas treatment) to increase the surface energy of the material. In general, the surface energy of a material having a modified surface falls within the ranges noted above.

In general, adhesive layer 150 is formed of a material that has good adhesion to both layers 130 and 160. In certain embodiments, adhesive layer 150 is formed of one or more polymeric adhesives. Examples of polymeric adhesives from which layer 150 can be formed include acrylate polymers, including rubber toughened acrylate polymers and high viscosity acrylate polymers. Examples of acrylate polymers include cyanoacrylate polymers, including rubber toughened cyanoacrylate polymers and high viscosity acrylate polymers. Examples of commercially available adhesive polymers from which layer 150 can be formed include Loctite® 401 adhesive, Loctite® 406 adhesive, Loctite® 410 adhesive and Loctite® 411 adhesive (Loctite Corporation, Rocky Hill, Conn.).

In general, adhesive layer 160 is formed of a material that has good adhesion to both layer 150 and window 140. Without wishing to be bound by theory, it is believed using a material with such adhesive properties for layer 160 can reduce the probability that window 140 will become un-adhered within polishing pad 100. This can be particularly desirable, for example, when window 140 is formed of a material that has a relatively low surface energy (e.g., when window 140 is formed of certain halogenated polymers, such as a PTFE). It is also believed that using a material with such adhesive properties for layer 160 can reduce the probability that liquid (e.g., slurry or water) will leak from surface 142 of window 140 to a region under window 140, layer 160, layer 150 and/or layer 140. This can be advantageous, for example, when such leaking of a liquid would interfere with the optical measurements being made (e.g., such as by moisture formation at a region under window 140, layer 160, layer 150 and/or layer 140).

In certain embodiments, adhesive layer 160 is formed of one or more polymeric adhesives. Examples of polymeric adhesives from which layer 160 can be formed include polyolefin polymers. Examples of commercially available adhesive polymers from which layer 160 can be formed include Loctite® primer adhesives (from Loctite Corporation, Rocky Hill, Conn.), such as Loctite® 770 primer adhesive, Loctite® 7701 primer adhesive, Loctite® 793 primer adhesive, Loctite® 794 primer adhesive, and Loctite® 7951 primer adhesive. In embodiments, layer 160 is formed of a primer for layer 150 (e.g., a primer for an acrylate polymer, a primer of a cyanoacrylate polymer).

While certain embodiments have been described, the invention is not so limited.

As an example, the shape of window 36 when viewing the pad from above can generally be selected as desired (e.g., a rectangular plug, a circular plug, an oval plug).

As another example, the shape of window 36 when viewing the pad along a crosssection (e.g., the view depicted in FIG. 1) can generally be selected as desired (e.g., rectangular, tapered, partially rectangular and partially tapered).

As an additional example, in certain implementations, window 36 can be partially supported by backing layer 20.

As another example, in some implementations, window 140 is formed of a material that has a relatively low surface energy, such as about 40 $mJ/m^2$ or less (e.g., about 37 $mJ/m^2$ or less, about 35 $mJ/m^2$ or less, about 33 $mJ/m^2$ or less, about 31 $mJ/m^2$ or less, about 25 $mJ/m^2$ or less, about 20 $mJ/m^2$ or less, about 18 $mJ/m^2$).

As a further example, a portion of opening 114 in covering layer 110 can be filled with a transparent solid piece 31, such as a quartz block (e.g., within window 140).

As yet another example, the polishing pad can be formed without layer 150.

As still a further example, the polishing pad can be formed without layer 160.

As another example, an additional layer of adhesive (e.g., formed of a material noted above for layer 130) can be present on the underside of backing layer 110. Typically, such an additional layer would not extend over opening 114 in layer 110.

As an additional example, the polishing head and the semiconductor substrate can translate during operation of the CMP apparatus. In general, the light source and the light detector are positioned such that they have a view of the substrate during a portion of the rotation of the platen, regardless of the translational position of the head.

As another example, the optical monitoring system within the CMP apparatus can be a stationary system located below the platen.

As an additional example, a polishing pad may contain a covering layer and no backing layer, or a polishing pad can be a fixed-abrasive pad with abrasive particles held in a containment media.

Other embodiments are in the claims.

What is claimed is:

1. A polishing pad comprising:

a polishing layer having a polishing surface; and a solid transparent window located in the polishing layer, the window being formed of a polymer material that provides the window with at least 80% transmission to light having a wavelength of about 400 to 410 nm, wherein the polymer material is a polyurethane substantially free of additives and substantially free of internal defects.

2. The polishing pad of claim 1, wherein the polymer material is a non-ambering urethane elastomer.

3. The polishing pad of claim 1, wherein the polymer material is polychlorotrifluoroethylene.

4. The polishing pad of claim 1, wherein the polymer material is hydrophilie.

5. The polishing pad of claim 1, wherein the polymer material has a hardness between 40 and 80 Shore D.

6. The polishing pad of claim 1, further comprising an antireflective coating on a bottom surface of the window.

7. The polishing pad of claim 1, wherein the polishing pad has a top surface that is recessed relative to the polishing surface.

8. The polishing pad of claim 1, wherein the bottom surface of the window includes a central portion and a perimeter portion, and the perimeter portion is rougher than the central portion.

9. The polishing pad of claim 8, further comprising:

a backing layer on the side of polishing layer opposite the polishing surface, wherein backing layer includes an aperture aligned with the window in the polishing layer, and wherein the perimeter portion of the window abuts the backing layer.

10. A polishing pad comprising:

a polishing layer having a polishing surface; and a solid transparent window located in the polishing layer, wherein a top surface of the transparent window is recessed relative to the polishing surface, and wherein the window is formed of non-ambering urethane elastomer.

11. The polishing pad of claim 10, wherein the top surface of the transparent window is recessed relative to the polishing surface by less than 5 mils.

12. The polishing pad of claim 11, wherein the top surface of the transparent window is recessed relative to the polishing surface by between 1 to 2 mils.

13. The polishing pad of claim 10, further comprising an anti-reflective coating on a bottom surface of the window opposite the top surface.

14. The polishing pad of claim 10, wherein:

the window is substantially free of additives and substantially free of internal defects.

15. The polishing pad of claim 10, wherein:

the window transmits light having a first wavelength and light having a second wavelength that is different from the first wavelength.

16. A polishing pad comprising:

a polishing layer having a polishing surface; and a solid transparent window located in the polishing layer, wherein a bottom surface of the window includes a central portion and a perimeter portion, and the perimeter portion is rougher than the central portion.

17. The polishing pad of claim 16, further comprising a backing layer on the side of polishing layer opposite the polishing surface.

18. The polishing pad of claim 17, wherein the perimeter portion of the window abuts the backing layer.

19. The polishing pad of claim 17, wherein backing layer includes an aperture aligned with the window in the polishing layer.

20. The polishing pad of claim 16, wherein:

the window is formed of a polymer material that is a non-ambering urethane elastomer.

21. The polishing pad of claim 16, wherein:

the window is formed of a polymer material that is a polyurethane substantially free of additives and substantially free of internal defects.

22. The polishing pad of claim 16, wherein:

the window transmits light having a first wavelength and light having a second wavelength that is different from the first wavelength.

* * * * *

UNITED STATES PATENT AND TRADEMARK OFFICE

CERTIFICATE OF CORRECTION

PATENT NO. : 6,994,607 B2
APPLICATION NO. : 10/464423
DATED : February 7, 2006
INVENTOR(S) : Andreas Norbert Wiswesser It is certified that error appears in the above-identified patent and that said Letters Patent is hereby corrected as shown below:

On The Title Page Item -56- Pg. 2 U.S. Patent Documents, after "6,517,417 B2 2/2003", replace "Roberts et al." with --Bundinger et al.--.

On The Title Page Item -56- Pg. 2 U.S. Patent Documents; after "6,537,133 B1 3/2003", replace "Johansson et al." with --Birang et al.--.

Col. 10, line 50 Claim 4, Line 2, change "hydrophilie" to --hydrophilic--.

Signed and Sealed this

Twenty-second Day of May, 2007

JON W. DUDAS
*Director of the United States Patent and Trademark Office*